US012644634B2

(12) United States Patent
Duman et al.

(10) Patent No.: US 12,644,634 B2
(45) Date of Patent: Jun. 2, 2026

(54) TRANSPORT ARRANGEMENT FOR A HOME APPLIANCE

(71) Applicant: BSH Hausgeräte GmbH, Munich (DE)

(72) Inventors: Özgür Duman, Tekirdag (TR); Erhan Kaya, Tekirdag (TR); Onur Hancerkiran, Tekirdag (TR); Ozan Özdemir, Tekirdag (TR)

(73) Assignee: BSH Hausgeräte GmbH, Munich (DE)

( * ) Notice: Subject to any disclaimer, the term of this patent is extended or adjusted under 35 U.S.C. 154(b) by 336 days.

(21) Appl. No.: 18/454,492

(22) Filed: Aug. 23, 2023

(65) Prior Publication Data

US 2024/0110741 A1 Apr. 4, 2024

(30) Foreign Application Priority Data

Sep. 30, 2022 (TR) ..... 2022/015051

(51) Int. Cl.
*F25D 11/00* (2006.01)

(52) U.S. Cl.
CPC ..... *F25D 11/003* (2013.01)

(58) Field of Classification Search
CPC ..... F25D 11/003
USPC ..... 410/121
See application file for complete search history.

(56) References Cited

U.S. PATENT DOCUMENTS

| | | | | | |
|---|---|---|---|---|---|
| 2,854,165 | A * | 9/1958 | Foster | B65D 19/16 | 217/43 A |
| 5,180,134 | A * | 1/1993 | Mallak | B65G 7/02 | 248/346.03 |
| 6,155,527 | A * | 12/2000 | Muyskens | B65D 19/0002 | 248/346.03 |
| 9,284,107 | B2 * | 3/2016 | Schultz | B65D 81/02 | |
| 10,557,589 | B1 * | 2/2020 | Carpenter | F16M 11/22 | |
| 11,460,235 | B1 * | 10/2022 | Hunter | F25D 23/006 | |
| 11,987,420 | B2 * | 5/2024 | Klump | B65D 19/0002 | |

FOREIGN PATENT DOCUMENTS

JP H09183438 A 7/1997

* cited by examiner

*Primary Examiner* — Steven O Douglas
(74) *Attorney, Agent, or Firm* — Laurence A. Greenberg; Werner H. Stemer; Ralph E. Locher

(57) ABSTRACT

A transport arrangement is provided for transporting a home appliance, particularly a cooling appliance having a housing defining an inner chamber. The transport arrangement includes a transport platform on which the home appliance is seated. The transport arrangement further includes one or more support devices connected to the housing from one side and to the transport platform from the other side, so as to support the housing from outside of the home appliance.

7 Claims, 5 Drawing Sheets

TRANSPORT ARRANGEMENT FOR A HOME APPLIANCE

CROSS-REFERENCE TO RELATED APPLICATION

This application claims the priority, under 35 U.S.C. § 119, of Turkish Patent Application TR 2022/015051, filed Sep. 30, 2022; the prior application is herewith incorporated by reference in its entirety.

FIELD AND BACKGROUND OF THE INVENTION

The present invention relates to a transport arrangement for transporting a home appliance having a housing (5) defining an inner chamber (2), particularly a cooling appliance, the transport arrangement including a transport platform (18) on which the home appliance (1) is seated.

DESCRIPTION OF THE RELATED ART

During the transportation of home appliances, damage can be caused by falling due to the weight of the appliance. Since home appliances, such as cooling appliances, are heavy products, there is the possibility of the appliance falling during transportation, which may damage the housing of the appliance. Moreover, such kinds of falls can adversely affect the operation of the appliances.

Japanese Publication JPH09183438A discloses a problem to be solved: to improve the efficiency of storage on the ground and loading of a truck or other carrier and make the load easy to handle, for example, by tightening the load together. The Japanese Publication JPH09183438A further discloses a solution: a pallet including support members each of which is long, is provided near a lateral side of a load, prevents the load from collapsing and includes brackets which respectively hold the support members. The bracket enables the support member to be turned down when attached. The support member when turned down with the interposition of the bracket is kept inside the pallet body in order not to project from the side of the pallet and a fastening device is provided, which prevents the projection of the support member.

SUMMARY OF THE INVENTION

It is accordingly an object of the invention to provide a transport arrangement for a home appliance, which overcomes the hereinafore-mentioned disadvantages of the heretofore-known devices of this general type, which has a strengthened structure and which provides an additional improvement, an additional advantage or an alternative to the prior art.

With the foregoing and other objects in view there is provided, in accordance with the invention, a transport arrangement for transporting a home appliance, particularly a cooling appliance, with a housing defining an inner chamber, the transport arrangement including a transport platform on which the home appliance is seated. The transport arrangement further includes one or more support devices connected to the housing from one side and to the transport platform from the other side, so as to support the housing from outside the home appliance. Thus, the housing of the home appliance is strengthened during transportation. Possible bending and damage to the housing of the appliance as a result of the home appliance falling are also prevented.

In this case, the home appliance can be any kind of heavy home appliance, such as a cooling appliance, in particular a refrigerator, a cooking appliance, in particular an oven, a dish washer or a washing machine.

In this case, the transport platform can be a pallet, particularly a wooden pallet.

In this case, the support device can be any kind of supporting element such as a bracket or a traverse.

In a possible embodiment of the invention, the support devices are configured to be connected to a first side panel of the housing, facing outside, to a second side panel which is adjacent to the respective first side panel of the housing, and to the transport platform. Thus, the support device supports both of the side panels, and the impact force occurring during a possible fall, is transferred directly to the housing. Therefore, the impact force can be evenly distributed to the housing.

In this case, the first side panel can be a side panel of the housing of the cooling appliance.

And in this case, the second side panel can be a side panel of a machine compartment of the cooling appliance. The machine compartment is a compartment in which the cooling system components such as compressors and valves are positioned.

The machine compartment and the housing of the cooling appliance can be separate parts. The machine compartment can be mounted/matched to the housing of the cooling appliance by an assembly process. During the assembly of the machine compartment and the housing of the cooling appliance, with the aid of the support device, the exact centering of the housing and excessive pressure are prevented. Thus, the machine compartment can easily be mounted/matched to the housing of the cooling appliance.

In a possible embodiment of the invention, the support device includes a first support part extending in a direction parallel to the side panels, and a second support part extending in a direction perpendicular to the first support part. Thus, the side panels are strengthened by connecting the side panels and the transport platform to each other rigidly.

In a possible embodiment of the invention, the first support part includes one or more first connection holes for connecting the support device to the first side panel, and one or more second connection holes for connecting the support device to the second side panel. Thus, the support device connects to the side panels.

In a possible embodiment of the invention, the second support part includes one or more third connection holes for connecting the support device to the transport platform. Thus, the support device connects to the transport platform.

In a possible embodiment of the invention, the support device includes at least two mutually-opposite connection lugs having one or more second connection holes. Thus, the support device supports the second side panel.

In a possible embodiment of the invention, two support devices are provided at the same side of the housing and the transport platform, so as to be spaced apart from each other. Thus, two support devices support the side panels in the depth direction of the same side of the home appliance.

In a possible embodiment of the invention, the support devices are provided at the opposite sides of the housing and the transport platform. Thus, the support device supports opposite sides of the housing.

In a possible embodiment of the invention, the support devices are made from sheet metal. Thus, the support device can be easily produced. And also the impact force occurring during a possible fall, is transferred to the housing easily.

In this context, with the indications "top," "bottom," "front," "rear," "horizontal," "vertical," "upward," "downward," "inner," "outer," "inward," "outward" etc. the positions and orientations given for intended use and intended arrangement of the home appliance and for a user then standing in front of the home appliance in a closed position and viewing in the direction of the appliance are indicated.

Other features which are considered as characteristic for the invention are set forth in the appended claims.

Although the invention is illustrated and described herein as embodied in a transport arrangement for a home appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In this detailed description, the subject matter is explained with reference to examples without forming any restrictive effect, only in order to make the subject more understandable.

Figure 1:
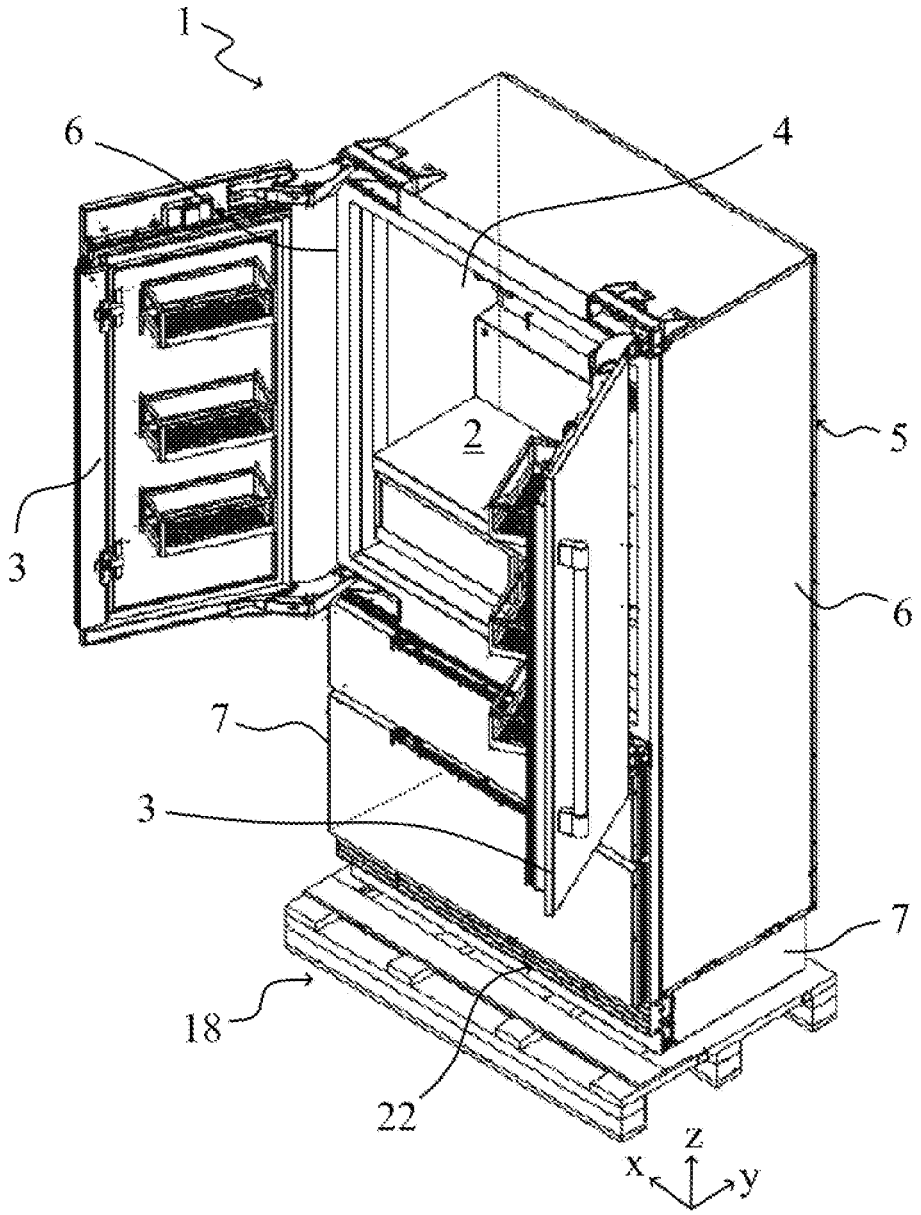
FIG. 1 is a representative diagrammatic, perspective view of the home appliance and the transport platform in which the home appliance is seated.
Figure 2:
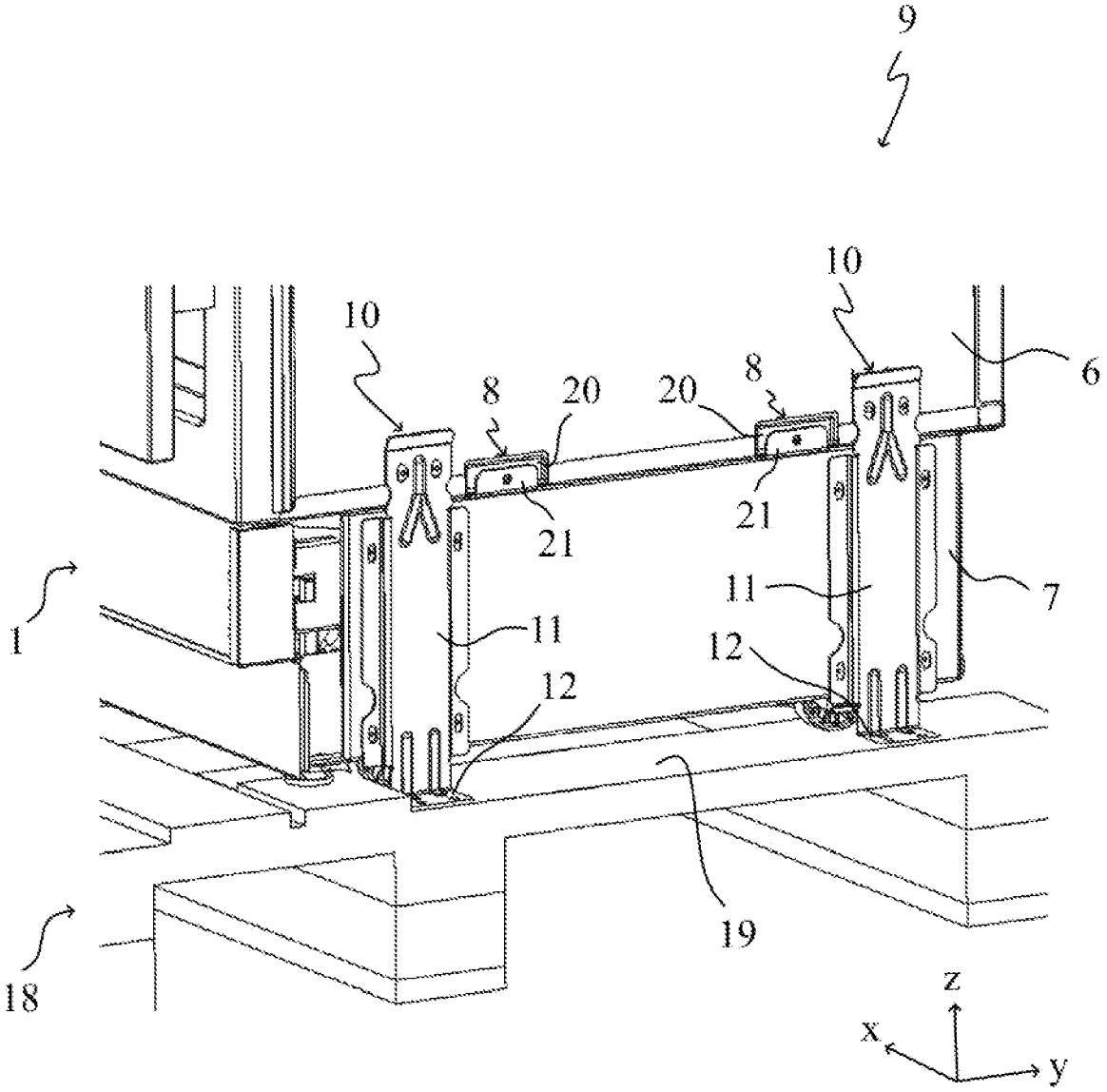
FIG. 2 is an enlarged, fragmentary, perspective view of the transport arrangement including a home appliance having a first side panel and a second side panel, a transport platform and a support device.
Figure 3:
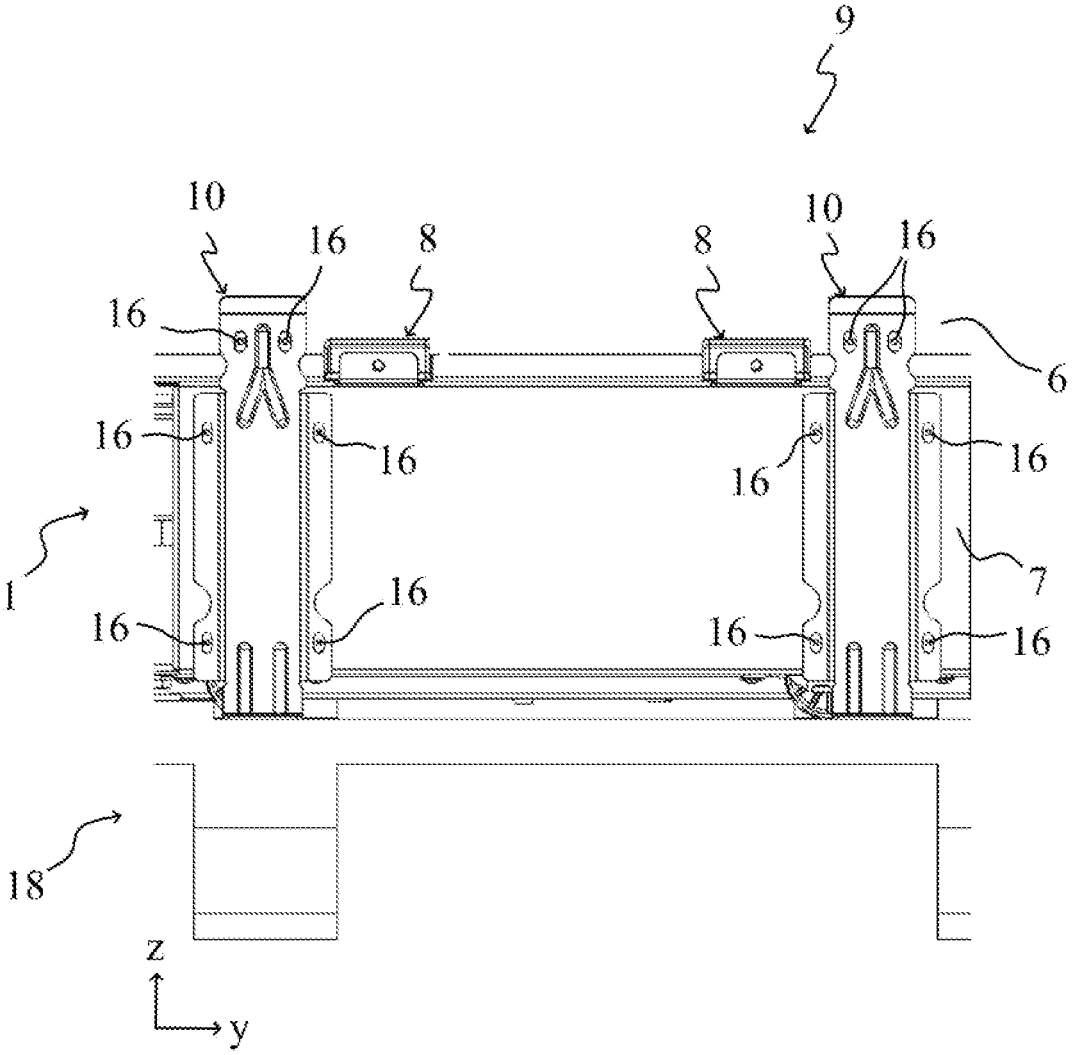
FIG. 3 is an enlarged, fragmentary, front-elevational view of the transport arrangement including a home appliance having a first side panel and a second side panel, a transport platform and a support device.
Figure 4:
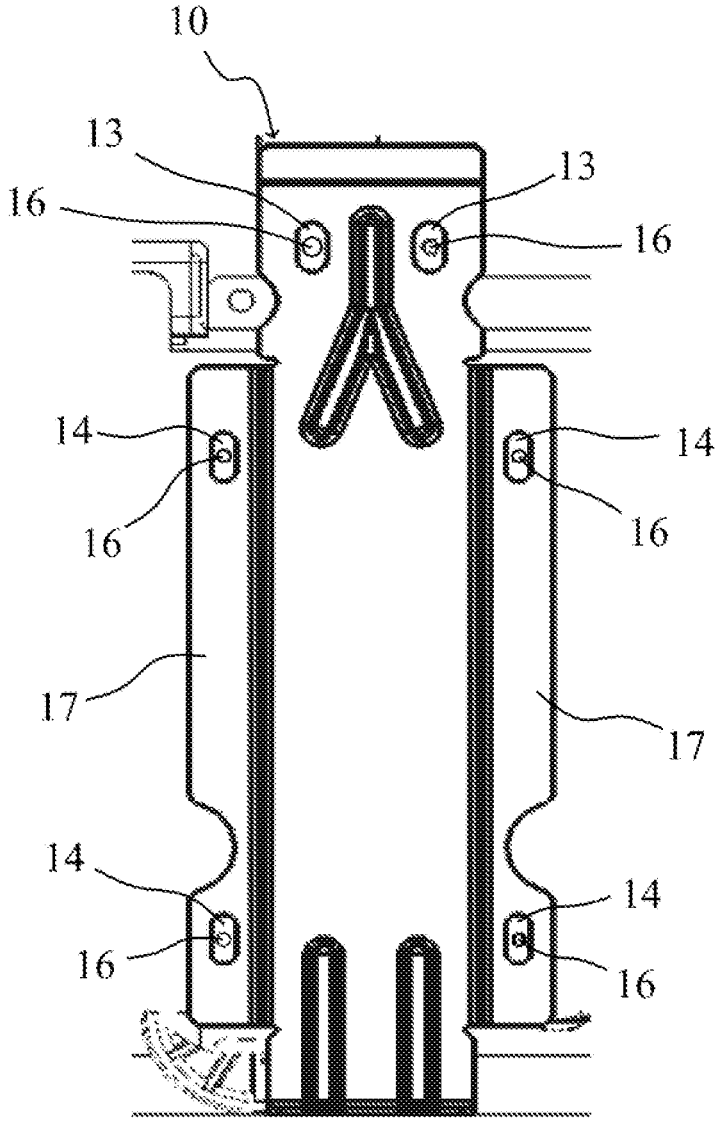
FIG. 4 is a further enlarged, fragmentary, front-elevational view of the transport arrangement where the support device is provided.

In this context, a width direction x which can be seen in FIG. 1, FIG. 2 and FIG. 3 corresponds to a width direction of the home appliance, storage compartment, machine compartment, transport platform and transport arrangement.

In this context, a depth direction y which can be seen in FIG. 1, FIG. 2 and FIG. 3 corresponds to a depth direction of the home appliance, storage compartment, machine compartment, side panels, transport platform and transport arrangement.

In this context, a height direction z which can be seen in FIG. 1, FIG. 2 and FIG. 3 corresponds to a height direction of the home appliance, storage compartment, machine compartment, side panels, transport platform and transport arrangement.

Referring now to the figures of the drawings in detail and first, particularly, to FIG. 1 thereof, there is seen a representative perspective view of an exemplary home appliance 1 and a transport platform 18 on which the home appliance 1 is seated. In FIG. 1, the exemplary home appliance 1 is a cooling appliance, such as a refrigerator. As can be seen in FIG. 1, the transport platform 18, in particular a pallet, is located on the ground. The home appliance 1 is seated on the transport platform 18. The home appliance 1 includes a housing 5 defining an inner chamber 2. There is an access opening 4 provided on a front side of the inner chamber 2 for accessing the inner chamber 2. At least one door 3 is hinged to the housing 5. The doors 3 are movable independently from each other between an open position in which the inner chamber 2 is accessible from outside, and a closed position in which the doors 3 completely cover the access opening 4. There is a machine compartment 22 having an inner space where cooling system members such as a compressor and valves are located. The machine compartment 22 is located on a lower side of the home appliance 1. In more detail, the machine compartment 22 is located between the housing 5 and the transport platform 18. On the other hand, the machine compartment 22 has two mutually-opposite second side panels 7. Similarly, the housing 5 also has two mutually-opposite first side panels 6 adjacent to the respective second side panels 7. The respective second side panels 7 are located below the respective first side panels 6. All of the side panels 6, 7 have an outer surface facing outside.

With reference to FIG. 2, in general, a transport arrangement 9 for transporting the home appliance 1, which is the subject matter of the invention, includes the transport platform 18 and a support device 10. In a possible embodiment of the invention, the transport arrangement 9 includes one or more support device 10 connected to the housing 5 from one side, and to the transport platform 18 from the other side. Thus, the support device 10 supports the housing 5 from outside the home appliance 1. The support devices 10 are disposed to be connected to a first side panel 6 of the housing 5, facing outside, to a second side panel 7 which is adjacent to the respective first side panel 6 of the housing 5, and to the transport platform 18. On the other hand, the respective first side panels and the respective second side panels are connected to each other via at least one housing connection region 8. As can be seen in FIG. 2. which shows the transport arrangement 9 provided at the right side, there are two housing connection regions 8 spaced apart from each other. Each of the housing connection regions 8 includes a first connection portion 20 provided on the first side panel 6, and a second connection portion 21 provided on the second side panel 7. One of the connection portions 20, 21 can be configured as a connection lug, and one of the connection portions 20, 21 can be configured as a connection groove. Each of the connection lugs and connection grooves can have one or more corresponding connection holes for connecting the side panels 6, 7 to each other via at least one connection element which is not shown, such as screws. Each of the connection lugs is seated onto the respective connection groove, and then the connection lugs are connected to the connection grooves via the screws. Thus, the side panels 6, 7 are assembled to each other. As can be seen in FIG. 2, two support device 10 are provided at the same side of the housing 5 and the transport platform 18, so as to be spaced apart from each other. In other words, at least one of the support device is positioned closer to the front side of the home appliance 1, and at least one of the support device is positioned closer to the rear side of the home appliance 1. Each of the support device 10 extends substantially in a height direction z of the side panels 6, 7.

Figure 5:
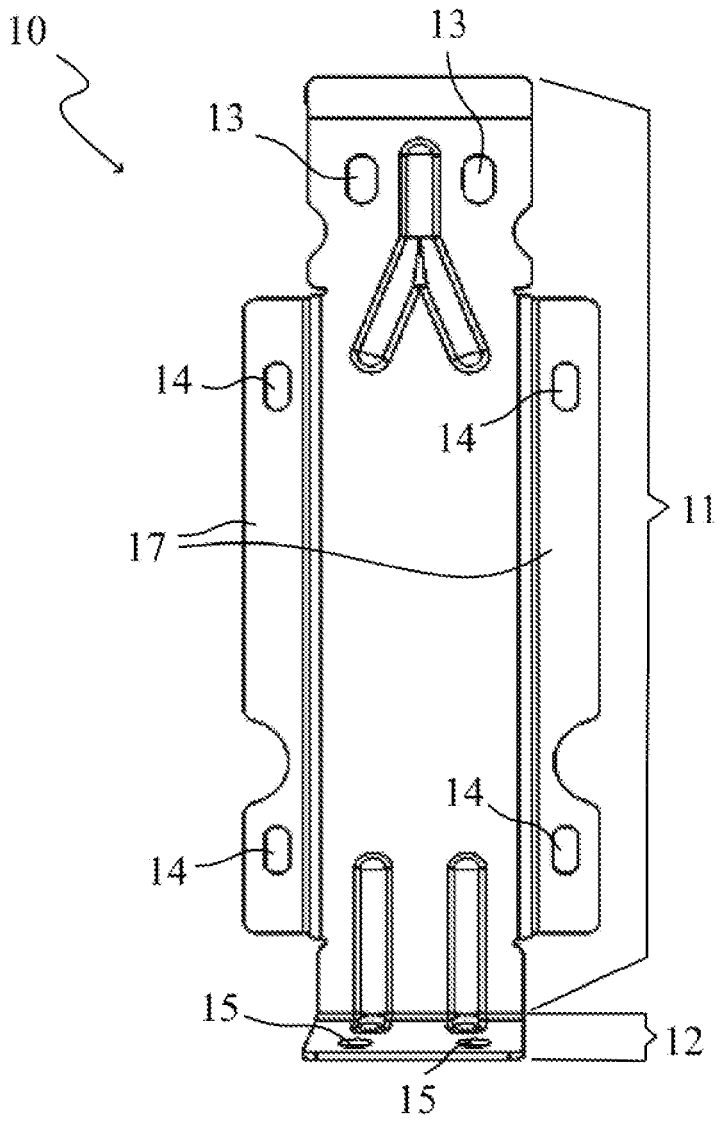
FIG. 5 is another enlarged, fragmentary, front-elevational view of the support device.

With reference to FIG. 5, each of the support devices 10 includes a first support part 11 extending in a direction parallel to the side panels 6, 7, and a second support part 12 extending in a direction perpendicular to the first support part 11. At least a portion of the first support part 11 is in substantially the same plane as the outer surface of the side panels 6, 7. As can be seen in FIG. 2, at least a portion of the first support part 11 abuts the first side panel 6 and the second side panel 7. The second support part 12 is seated onto an upper surface 19 of the transport platform 18 facing the home appliance 1. At least a portion of the second support part 12 is in substantially the same plane as the upper surface 19. In a possible embodiment, the first support part 11 includes one or more first connection holes 13 for connecting the support device 10 to the first side panel 6. As can be seen in FIGS. 2 to 5, preferably, there are two first connection holes 13 spaced apart from each other in a depth direction y. The first side panel 6 has corresponding connection holes 16 corresponding the first connection holes 13. Preferably, the first connection holes 13 are bigger than the corresponding connection holes 16. Thus, during the assembly process, the support device 10 can easily be positioned in such a way that each of the first connection holes 13 corresponds to the respective corresponding connection holes 16. The first support part 11 further includes one or more second connection holes 14 for connecting the support device 10 to the second side panel 7. The support device 10 includes at least two mutually-opposite connection lugs 17 extending in the height direction z. As can be seen in FIGS. 2 to 5, the connection lugs 17 abut the second side panel 7. Each of the connection lugs 17 has one or more of the second connection holes 14. Preferably, each of the connection lugs 17 has two second connection holes 14. The two second connection holes 14 are spaced apart from each other in the height direction z of the support device 10. The second side panel 7 has corresponding connection holes 16 corresponding the second connection holes 14. Preferably, the second connection holes 14 are bigger than the corresponding connection holes 16. Thus, during the assembly process, the support device 10 can easily be positioned in such a way that each of the second connection holes 14 corresponds to the respective corresponding connection holes 16.

As can be seen in FIGS. 2 and 5, the second support part 12 of the support device 10 extends in a direction perpendicular to the first support part 11. In a possible embodiment, the second support part 12 includes one or more third connection holes 15 for connecting the support device 10 to the transport platform 18. The transport platform 18 has corresponding connection holes which are not shown corresponding to the third connection holes 15. A connection element which is not shown, such as a screw, passes through the respective third connection holes 15 and the corresponding connection holes.

When each of the support devices 10 is assembled to the respective side panels 6, 7 and the transport platform 18, the housing 5 of the home appliance 1 is strengthened during transportation. Also, possible bending and damage to the housing 5 of the home appliance as a result of the home appliance 1 falling, is prevented.

In a possible embodiment of the invention, the support devices 10 are provided at the opposite sides of the housing 5 and the transport platform 18. In more detail, one or more support devices 10 are provided at the left side of the home appliance 1 and the transport platform 18, and similarly one or more support devices 10 are provided at the right side of the home appliance 1 and the transport platform 18.

In a possible embodiment of the invention, both of the support devices 10 are made from sheet metal. Thus, the support devices 10 can easily be produced by sheet bending and cutting processes. Additionally, the impact force occurring during the home appliance 1 possibly falling, is easily transferred to the housing 5.

The following is a summary list of reference numerals and the corresponding structure used in the above description of the invention.

REFERENCE LIST

1. Home appliance
2. Inner chamber
3. Door
4. Access opening
5. Housing
6. First side panel
7. Second side panel
8. Housing connection region
9. Transport arrangement
10. Support device
11. First support part
12. Second support part
13. First connection holes
14. Second connection holes
15. Third connection holes
16. Corresponding connection hole
17. Connection lugs
18. Transport platform
19. Upper surface
20. First connection portion
21. Second connection portion
22. Machine compartment
x. width direction
y. depth direction
z. height direction

The invention claimed is:

1. A transport arrangement for transporting a home appliance or cooling appliance having a housing defining an inner chamber, the transport arrangement comprising:

a transport platform for seating the home appliance on said transport platform; and at least one support device having one side connected to the housing and another side connected to said transport platform, for supporting the housing from outside of the home appliance;

said at least one support device configured to be connected to a first outwardly-facing side panel of the housing, to a second side panel disposed adjacent to said first side panel of the housing, and to said transport platform;

said at least one support device including a first support part extending in a direction parallel to the side panels, and a second support part extending in a direction perpendicular to said first support part;

said first support part including at least one first connection hole for connecting said at least one support device to the first side panel, and at least one second connection hole for connecting said at least one support device to the second side panel.

2. The transport arrangement according to claim 1, wherein said second support part includes at least one third connection hole for connecting said at least one support device to said transport platform.

3. The transport arrangement according to claim 1, wherein said at least one support device includes at least two mutually-opposite connection lugs having said at least one second connection hole.

4. The transport arrangement according to claim 1, wherein said at least one support device includes two support devices spaced apart from each other and provided at the same side of the housing and said transport platform.

5. The transport arrangement according to claim 1, wherein said at least one support device includes two support devices provided at opposite sides of the housing and said transport platform.

6. The transport arrangement according to claim 1, wherein said at least one support device is made of sheet metal.

7. A combination, comprising:

a home appliance including:

a housing defining an inner chamber, said housing having an access opening on a front side for accessing said inner chamber and at least one door hinged to said housing, said housing including a first outwardly-facing side panel, and a machine compartment disposed adjacent to said housing and including a second outwardly-facing side panel; and a transport arrangement including:

a transport platform, said home appliance being seated on said transport platform, and at least one support device connected to said first outwardly-facing side panel of said housing, to said second outwardly-facing side panel of said machine compartment, and to said transport platform, for supporting said housing from outside of said home appliance.

* * * * *